US006641877B2

(12) United States Patent
Johnson

(10) Patent No.: US 6,641,877 B2
(45) Date of Patent: Nov. 4, 2003

(54) ARTICLE AND METHOD FOR RETARDING THE DETERIORATION RATE OF ACIDIC PAPER

(76) Inventor: Ronald E. Johnson, 46 S. Main St., Tioga, PA (US) 16946

( * ) Notice: Subject to any disclaimer, the term of this patent is extended or adjusted under 35 U.S.C. 154(b) by 0 days.

(21) Appl. No.: 09/797,934

(22) Filed: Mar. 2, 2001

(65) Prior Publication Data

US 2002/0195217 A1 Dec. 26, 2002

(51) Int. Cl.[7] ..... B32B 27/18; B32B 27/30; B32B 27/32; B32B 27/36; B65D 81/24

(52) U.S. Cl. ..... 428/35.2; 428/35.7; 428/413; 428/447; 428/480; 428/522; 428/523; 206/205; 422/40

(58) Field of Search ..... 206/205; 422/40; 428/35.2, 35.5, 35.7, 36.92, 413, 480, 522, 523, 483, 447

(56) References Cited

U.S. PATENT DOCUMENTS

| | | | | | |
|---|---|---|---|---|---|
| 2,033,452 | A | | 3/1936 | Schierholtz | 162/160 |
| 3,472,611 | A | | 10/1969 | Langwell | 427/248.1 |
| 3,676,182 | A | | 7/1972 | Smith | 427/316 |
| 3,771,958 | A | | 11/1973 | Kusterer, Jr. et al. | 427/248.1 |
| 3,898,356 | A | | 8/1975 | Williams et al. | 427/343 |
| 3,939,091 | A | | 2/1976 | Kelly, Jr. | 252/189 |
| 3,969,549 | A | | 7/1976 | Williams et al. | 427/248 |
| 4,051,276 | A | | 9/1977 | Williams et al. | 427/248 |
| 4,151,144 | A | * | 4/1979 | Dyson et al. | 524/556 |
| 4,318,963 | A | | 3/1982 | Smith | 428/537 |
| 4,522,843 | A | | 6/1985 | Kundrot | 427/27 |
| 4,863,566 | A | | 9/1989 | Warren et al. | 162/160 |
| 4,927,497 | A | | 5/1990 | Sharpe | 162/160 |
| 5,104,997 | A | | 4/1992 | Kamienski et al. | 556/130 |
| 5,219,524 | A | | 6/1993 | Evans, II | 422/46 |
| 5,264,243 | A | | 11/1993 | Wedinger et al. | 427/140 |
| 5,322,558 | A | | 6/1994 | Wittekind et al. | 106/257.24 |
| 5,393,562 | A | | 2/1995 | Sebera | 427/248.1 |
| 5,409,736 | A | | 4/1995 | Leiner et al. | 427/372.2 |
| 5,433,827 | A | | 7/1995 | Page et al. | 162/160 |
| 5,676,909 | A | * | 10/1997 | Hollinger, Jr. | 162/181.2 |
| 5,922,280 | A | | 7/1999 | Hollinger, Jr. | 422/40 |

OTHER PUBLICATIONS

"Book Preservation Technologies", Congress of the United States, Office of Technology Assessment, U.S. Printing Office, Oct. 1988.

* cited by examiner

*Primary Examiner*—Ramsey Zacharia
(74) *Attorney, Agent, or Firm*—Nixon Peabody LLP

(57) ABSTRACT

A method for retarding the deterioration rate of acidic paper is disclosed. The method includes placing an acidic paper article in a polymer film enclosure having a reservoir of deacidifying agent. The deacidifying agent migrates over time to the paper article in an amount sufficient to retard the deterioration rate of the paper. The method can further include placing in the polymer film enclosure a carrier material having a second reservoir of deacidifying agent. An article for retarding the deterioration rate of acidic paper is also disclosed. The article includes a polymer film enclosure having a reservoir of deacidifying agent. The polymer film enclosure is capable of enclosing an acidic paper article. The deacidifying agent is capable of migrating over time to the acidic paper article enclosed therein in an amount sufficient to retard the deterioration rate of the paper. The article can further include a carrier material having a reservoir of deacidifying agent.

66 Claims, No Drawings

ARTICLE AND METHOD FOR RETARDING THE DETERIORATION RATE OF ACIDIC PAPER

BACKGROUND OF THE INVENTION

1. Field of the Invention

The present invention relates to an article for retarding the deterioration rate of acidic paper and a method of use thereof. In particular, the present invention relates to an article capable of enclosing an acidic paper and having a reservoir of a deacidifying agent for retarding the deterioration rate of the acidic paper and method of use thereof.

2. Description of the Related Art

Paper, of course, is an inexpensive material used for a wide range of products, most of which are discarded after use. The vast majority of paper products are destroyed or recycled within a decade of manufacture. On the other hand, there are innumerable items of value which are also made of, or on, paper. These include critical documents, art prints, original drawings, limited edition books, etc. Usually many of these items are already quite old when the need for preservation is recognized. In general so many paper items are destroyed that the survivors often become collectible after a period of time. The time for an item to be considered collectible, or otherwise merit preservation, varies, of course, depending on the particular item, but most commonly falls between 20 and 100 years. Some items have historical or artistic value from the moment of their creation, but most items are already slightly deteriorated when preservation becomes a goal.

Paper dates back to the second century AD when it was invented in China. Prior to then books, documents, etc. were printed primarily on parchment or vellum. The Arabs began using rags as the cellulose fiber source for paper, and rags remained the primary fiber source when paper making was introduced into Europe by the Moors in the 1100s. Initially most rags were linen, but later cotton came into common use. Rags continued to be the principal fiber source until the early 1850s, when the demand for paper had reached such heights, that the supply of rags was insufficient to produce paper in the quantity needed. A paper manufacturer in New England had even resorted to using linen-wrapped mummies from Egypt as a fiber source for certain papers. Around 1850 wood fiber began to replace rags as the cellulose fiber source. Paper manufacture underwent a dramatic change using chemical, then mechanical, pulping processes to convert wood fiber into paper. After the commercial introduction of a mechanical process for ground wood pulp in 1867, almost all paper contained wood pulp in at least some proportion. Although these changes enabled paper manufacturing to meet the ever increasing demands for paper, the changes resulted in a significant increase in the rate of paper deterioration upon aging. The lignin in wood pulp papers forms acid upon aging, and acid catalyzed hydrolysis is the principal mechanism for cellulose degradation and consequent strength loss. Many of the other changes that had been occurring in paper making since the 17th century had also resulted in increased acid in the paper. One such example is the use of alum-rosin sizing which has been a common practice since the early 1800s. The consequence is that many of the books printed in the late 1800s and early 1900s are in worse condition from the paper standpoint than books printed in the 1600s. Many newspapers and paperback novels printed as recently as the 1930s are now almost unreadable due to the advanced state of paper deterioration.

It has been reported in "The Self-Destructing Book", by John Dean, *Encyclopedia Britannica: Yearbook of Science and the Future,* 1989, that up to 25% of the books in the Library of Congress collection already are deteriorated to the point that their use is affected. Newspapers, of course, are an example of paper that deteriorates very rapidly. Most newspapers show significant embrittlement and discoloration after a single decade, or even after a few weeks if kept in a warm environment or exposed to light. High humidity can also accelerate the deterioration rate ("Artificially Accelerated Aging of Paper", by R. R. Yabrova, in *Collection of Materials on the Preservation of Library Resources*, Israel Program for Scientific Translations).

The biggest enemy of paper is the acid formation prevalent in most papers produced after the 1850s. Although the use of alkaline paper is increasing, even today most paper is still acidic. The rates of acid deterioration, as well as other mechanisms of chemical deterioration, are accelerated by heat; and, unfortunately, normal warm ambient temperatures are sufficient to accelerate the deterioration significantly. If it needs to be readily accessible, paper should be stored between 68 and 70 degrees Fahrenheit with a relative humidity between 45 and 50 percent ("The Self-Destructing Book", by John Dean, *Encyclopedia Britannica: Yearbook of Science and the Future,* 1989). If frequently handled, lower temperature and humidity are not considered ideal, even though most chemical deterioration mechanisms are further slowed, because excessive loss of moisture from the cellulose fibers causes the papers to become brittle. On the other hand, if storage is to be over long periods without disturbance, then lower temperature and humidity conditions are preferred ("Newsprint and Its Preservation", Preservation leaflet No. 5, Library of Congress, 1981; *Preserving Library Materials, A Manual*, by Susan G. Swartzburg, The Scarecrow Press, 1995). Heat, and light (particularly UV), are paper's major enemies. Other causes of deterioration include insects, rodents, water, mold (primarily mildew), and air pollutants, besides the obvious wear from handling or use.

Air pollutants can contribute very significantly to paper deterioration, particularly in industrial and urban areas of developing countries ("Paper and Its Preservation", Preservation Leaflet No. 2, Library of Congress, 1983 (revised)). Even in a home environment, however, air pollutants can have a significant impact on paper discoloration and deterioration. In one observed case a newspaper sheet dating from the 1700s, which well predated the manufacture of acidic paper, was stored in a drawer that was closed (dark) 99+% of the time. On top of the paper a narrow strip of sheet metal happened to be lying across the paper. The metal strip laid undisturbed on the paper for about 10 years. The paper directly under the metal strip was noticeably lighter in color, and it appeared somewhat less embrittled than the remaining area, after the 10 year period, even though the metal was only lying on the paper surface. Although in the dark, the paper was exposed to the atmosphere, and the room was located over a kitchen. The room also got quite warm during the summer months. The paper exposed to the atmospheric pollutants, presumably from the kitchen, or a cat litter box which was located in the same room, discolored and deteriorated more during this 10 year period than it had during the previous 200 years; moreover, something as simple as a metal strip lying on the surface significantly changed the deterioration rate.

Air pollutants, water, rodents, mold, and light are external enemies of paper. These contributors to deterioration can in general all be reduced by enclosing the paper article in a protective encasement. Acid deterioration, on the other hand, is inherent in most papers from the time of manufacture. In fact, air tight enclosure of acidic papers can actually speed the deterioration rate ("Paper: Manuscripts, Documents, Printed Sheets, and Works of Art", by Karl Buchberg, in *Conservation in the Library*, edited by Susan Garretson Swartzburg, Greenwood Press, 1983).

Although even under ideal conditions all paper will deteriorate slowly by oxidation, non-acidic papers can last centuries with no significant observable change. Acidic papers, however, seldom last more than a decade before some change in appearance and properties are readily observable. Most preservation techniques for these papers include a deacidification step. A minimum pH of 6 is sufficient to effect a significant reduction in the rate of acid hydrolysis of cellulose, but it is generally reported that papers with a pH between 7.5 and 8.5 are preferred. Higher pHs do not result in even lower deterioration rates, and can in fact have other negative effects. High alkalinity is suspected to increase the paper oxidation rate, and can cause paper discoloration. The simplest means to deacidify the paper is to coat it with various carbonates; the carbonates of calcium and magnesium are the carbonates most commonly employed, and they are often simply sprayed onto the paper surfaces. Some moisture can aid migration of the base into the paper, but migration does not readily occur over long distances, such that this technique is most effective when each page is treated individually. Commercial deacidifying solutions are available both in aqueous and non-aqueous versions. In these solutions the paper article can be totally immersed followed by drying, or individual sheets can be sprayed. Bookkeeper and Wei T'o are the most readily available commercial examples. The Bookkeeper material is a dispersion of magnesium oxide in a solvent, and it most commonly is used as a spray. A surfactant is added to aid in maintaining the particles in suspension. The Wei T'o materials employ either methoxy magnesium(methyl)carbonate or ethoxy magnesium(ethyl) carbonate as the neutralizing agent, depending on the specific solution selected. The differently numbered Wei T'o solutions also differ in the solvents employed, and, in consequence, vary in penetrating power and risk of ink dissolution. Wei T'o is available both as a spray and solutions for immersion. In both the Bookkeeper and the Wei T'o materials, the solvents evaporate quickly leaving the neutralizing agent on the surface of the paper fibers.

There are vapor and other solution impregnation treatments which are known to be beneficial to preservation, and which can be employed on a larger scale (*Mass Deacidification of Paper*, by Astrid-Christiane Brandt, Bibliotheque Nationale, 1992). Most of these, maybe all, involve acid neutralization as part of the process. One example is the process developed by Battelle in Germany, which uses a magnesium alkoxide for the base dissolved in hexamethyidisiloxane. Another example is the diethyl zinc (DEZ) process developed by Akzo Chemical. In general, these processes are relatively expensive, can have some negative side effects, and are not available to the average collector, small library, museum, etc. These approaches are most appropriate for large scale treatment of books by major libraries, governmental agencies, etc., which have major inventories to treat.

Many alkaline materials have been evaluated for acid neutralization in paper. The use of barium hydroxide in methanol, and various aqueous alkaline solutions were employed in the earliest approaches. In U.S. Pat. No. 3,676,812 and U.S. Pat. No. 5,104,997 magnesium alkoxides in organic solvents were employed. In U.S. Pat. No. 3,938,091 a methyl magnesium carbonate in an organic solvent was used. Diethyl zinc was employed in U.S. Pat. No. 4,051,276 and particles of inorganic alkaline hydroxides or carbonates in U.S. Pat. Nos. 4,522,843 and 5,433,827. Neutralization by ammonia was also evaluated, but due to ammonia's volatility, the neutralization effect was only temporary. More recently in U.S. Pat. No. 5,393,562 a low concentration of ammonia in the atmosphere has been proposed as a means to neutralize, or maintain neutralization, during long term storage of books and other paper articles. Amino-functional materials have also been evaluated. Morpholine was disclosed as an effective neutralizing agent in U.S. Pat. No. 3,771,958, and carbonate or acetate salts of cyclohexamine in U.S. Pat. No. 3,472,611. In U.S. Pat. No. 4,863,566 low molecular weight amines for deacidification were produced in situ by introducing ammonia and an alkene oxide into an evacuated chamber containing the cellulosic material. This latter process is known as the Booksaver Process, and it exhibits two negatives common for deacidification by amines. First, the deacidification is not permanent. Many of the amines are volatile or form unstable salts, such that the papers again become acidic upon continued aging. Secondly, the ethanolamine formed tends to turn the paper yellow. Many papers are discolored by amine deacidification, turning yellowish or brownish.

W. H. Langwell in the late 1960's used sheets of paper impregnated with cyclohexamine carbonate and placed them between pages of a book as a means to neutralize paper in books. The book was left in a sealed chamber for several hours during which neutralization occurred by migration. The treatment, however, was not that effective and the neutralizing agent exhibited the negatives commonly experienced when using lower molecular weight amines, including concerns over odor and toxicity (*Mass Deacidification of Paper*, by Astrid-Christiane Brandt, Bibliotheque Nationale, 1992; "Book Preservation Technologies", Congress of the United States, Office of Technology Assessment, U.S. Printing Office, 1988).

The average collector of paper items often resorts to enclosing the item in a protective polymer sleeve. The sleeve is usually transparent to allow items such as prints, postcards, art drawings, magazine covers, etc. to be viewed without removal. Transparency is considered essential, or most certainly preferable, in almost all cases, even for books, because it facilitates identification, and allows viewing of those that have decorative or pictorial covers. Single sheet, or documents with a relatively few number of sheets, can even have each page laminated or sealed in a plastic sleeve. Lamination is not desirable if the plastic adheres to the original, as it preferable to maintain the original in an unmodified state. For books, and documents with multiple pages, enclosure in a polymer film means they must be removed for perusal, but in most cases this is infrequent enough not to be a major negative. Some major book suppliers have already begun encasing their inventory in polymer shrink-wrap where it remains until removed by a purchaser. The use of polymer films for protection is inexpensive and available to virtually everyone. Enclosure in a plastic film stops completely some causes of deterioration, such as that caused by water, insects, or mold. It slows others, such as that caused by light, oxidation, and atmospheric pollutants. It probably even reduces the rodent threat to some degree. Acid deterioration, on the other hand, may not be significantly retarded. In fact, it has been reported in "Paper: Manuscripts, Documents, Printed Sheets, and Works of Art", by Karl Buchberg, in *Conservation in the Library*, edited by Susan Garretson Swartzburg, Greenwood Press, 1983 that air-tight enclosure can accelerate deterioration. The polymer films retard oxygen and moisture diffusion into the paper due to the low permeability of the film, but at the same time any acids formed are trapped in the enclosure. It is not evident that a thorough study has been made on the effects of key polymer film properties on the chemical mechanisms of deterioration. Obviously a thorough understanding of this could lead to a better polymer selection for film enclosure preservation.

The polymers commonly employed as films for preservation are polyethylene, polypropylene, and polyester (most commonly polyethylene terephthalate), all of which are generally used as clear transparent films in the 1 to 10 mil range. Often the polymer grade used is referred to as the archival grade, meaning non-acidic, high clarity, and containing no plasticizers or other additives which can be deleterious to the paper. Selection of a specific polymer often depends on the desired rigidity. The polymers also differ in their permeability properties, with polyethylene terephthalate (PET) exhibiting the lowest permeability. Polyethylene, being very flexible and stretchable, is preferred for applications where these characteristics are desirable. Polyethylene is also low cost and readily available. Polypropylene offers a slight increase in stiffness, and PET a substantial increase in stiffness. The physical properties needed depend upon the particular preservation application. PET due to its relative rigidity, for example, might be suitable for a postcard, but not for a book. A book requires a more flexible or conformal film. In a few specialized cases where static charge is an issue, nylon films may be employed. In some display applications utilizing heavier sheets rather than films, UV absorbing grades of acrylic or polycarbonate are used. Until recently PVC and PVDC were often used for the film applications, but now it is generally known that they were poor choices due to plasticizer loss and acid formation upon aging of the polymer.

There are many suppliers of polymer sleeves, bags, etc. for paper preservation. Targeted paper applications range from books to stamps, and a complete list would be very extensive. Sometimes the paper items are heat laminated to the film, or heat shrink films are conformed tightly against the surface, but most often the items are simply placed in a plastic sleeve or bag which is then adhesive or heat sealed. In some cases the only seal is an electrostatic one, and in some cases zip-lock and other mechanical seals are used as common in the food industry. Co-extruded films used for food applications have not commonly been used for paper preservation. This may be simply because no one has generated sufficient data to justify their use; however, it is more likely that the films designed for food are not ideal for paper preservation. Permeability to humidity, for instance, is of far greater concern in the food case, than in the paper preservation case. The use of multi-layered films, however, may be very applicable to the paper preservation case, provided the film structure is designed to address the specific problems relevant to paper.

Non-reactive additives are compounded into polymers for a wide variety of reasons. These include plasticizers, antioxidants, UV absorbers, dyes, anti-blocking agents, slip agents, etc. Migration or loss of these additives upon aging is in fact often considered a problem. It is also known that compounding additives of carefully selected solubility parameters into polymers can result in the additives concentrating at the polymer surface after processing. This is often desirable for anti-blocking and slip agents, as well as surface modification for wetting, bacteriological compatibility, etc. The chemistry of the additives also varies widely and includes fatty amides for non-blocking, silicones for release, etc. It should be noted that sometimes an alternative to compounding the additive directly into the polymer is to apply the additive to the surface, either as a coating or an additive in a coating; but, the coating approach is often less durable, and more costly overall due to the additional application step.

For non-reactive additives, additive loss through migration is a frequent problem. For this reason in many applications, newer reactive or higher molecular weight additives are being developed. An example problem is the case of deposition of plasticizer on automobile windshields over an extended use period. The plasticizer source is the vinyl materials used in the car's interior. Anyone owning a car in the 1960s and 1970s remembers when this was a significant problem. After only a few years, the inside surface of the windshield would have a greasy feel and constantly look as if it needed cleaning. Even today, after years of research into reducing plasticizer migration, the problem still exists, although it is far less than previously. When the car interior heats during the day, especially in the sun, the plasticizer volatilizes, and then when the temperature falls it condenses on the cooler surfaces. The plasticizers, however, were never chosen to be volatile. Even in the 1960s, plasticizers were chosen with stability in mind. Dioctyl phthalate was one of the common ones. Since then higher molecular weight plasticizers are being used, and migration is vastly reduced, although still not non-existent. Similar migration problems have plagued formulators of multiple ingredient polymer compounds, including inks, coatings, and adhesives, because many formulations commonly contain ingredients in the 200 to 500 molecular weight range. Migration results in property changes in use, or in some cases upon long term storage prior to use. Thermoplastic decorating media for ceramic and glass applications commonly employ fatty alcohols and other waxes. It is common to observe the fatty alcohols in the C16 to C22 range, if stored for long periods, to appear as a whitish bloom on the surface or a whitish deposit on the containers. The key point here is that migration is common for organic molecules in the molecular weight range common for plasticizers and waxes; i.e., 200–500. The mechanism of migration may be volatilization followed by condensation, as in the automotive case, or migration may occur by other means. The vapors can be adsorbed onto surfaces through chemical attraction. Condensates can be absorbed into pores by capillary action. Migration can simply be surface or bulk diffusion, or the migrating materials can be carried along through dissolution into or association with other migrating molecules such as water. As in the automotive case described above, migration in most cases is an undesirable rather than a desirable occurrence. The migration of silicone fluids, for example, is notorious for contaminating surfaces which subsequently exhibit problems with coatings, inks, and/or adhesives due to the inability of these materials to wet the silicone-contaminated surfaces. The silicone fluids readily migrate, not just due to volatilization, but due also to their very low surface energy which enables them to wet and spread over almost all surfaces with which they come into contact.

In the field of paper preservation, molecular migration is already evident with certain materials. The acid itself migrates, and acidic papers or other materials adjacent to neutral or basic papers can cause them to deteriorate. Migrating acids from adhesives, book covers, tapes, etc. often cause localized deterioration. As described in U.S. Pat.

No. 5,433,827 buffered papers placed adjacent to acidic papers can under certain conditions of pressure and humidity result in deacidification of the acidic paper by migration of the base into the acidic paper. Since inorganic carbonates are primarily employed, the humidity obviously plays a key role in this migration.

SUMMARY OF THE INVENTION

In accordance with one aspect of the present invention, there is provided a method for retarding the deterioration rate of acidic paper including providing a polymer film enclosure having a reservoir of deacidifying agent and placing an acidic paper article in the polymer film enclosure, wherein the deacidifying agent migrates over time to the paper article in an amount sufficient to retard the deterioration rate of the paper.

In accordance with another aspect of the present invention, the method can further include placing a carrier material in a polymer film enclosure, wherein the carrier material includes a reservoir of deacidifying agent.

In accordance with another aspect of the method of the present invention, the polymer film can be a multi-layered film including at least one layer that serves as a barrier against loss of the deacidifying agent from the enclosure to the outer environment, and at least one layer in communication with the deacidifying agent.

In accordance with another aspect of the present invention, there is provided an article for retarding the deterioration rate of acidic paper. The polymer film enclosure has a reservoir of deacidifying agent and is capable of enclosing an acidic paper article, wherein the deacidifying agent is capable of migrating over time to the acidic paper article enclosed therein in an amount sufficient to retard the deterioration rate of the paper.

In accordance with another aspect of the present invention, the article further includes a carrier material in the polymer film enclosure, wherein the carrier material includes a second reservoir of deacidifying agent.

In accordance with another aspect of the article of the present invention, the polymer film can be a multi-layered film including at least one layer that serves as a barrier against loss of the deacidifying agent from the enclosure to the outer environment, and at least one layer in communication with the deacidifying agent.

These and other aspects of the present invention will become apparent upon a review of the following detailed description and the claims appended thereto.

DETAILED DESCRIPTION OF PREFERRED EMBODIMENTS

The present invention relates to a method for retarding the deterioration rate of acidic paper articles wherein the deacidification occurs during ambient storage in an enclosure by gradual migration of the deacidifying agent to the acidic paper from a reservoir in the enclosure and/or a carrier material. In a preferred case, the reservoir is the polymer film used for the enclosure. The agent can be an additive in the film, a coating on the film, or an additive in the coating on the film. The reservoir can be a carrier material alone or in combination with the film. Preferably, the polymer film is a multi-layered film with one layer serving as a barrier against migration from the enclosure, and one layer serving as a reservoir for the deacidifying agent. More preferably, the agent is selected to exhibit only partial miscibility in the polymer film, such that the agent concentrates at the surface following film processing or film coating. Alternatively for higher molecular weight deacidifying agents, the agents can be impregnated into porous materials which are placed within the enclosure along with the articles needing deacidification. An amino-functional silicone was found to be a particularly effective deacidifying agent for the practice of this invention.

The article for retarding the deterioration rate of acidic paper includes a polymer film enclosure having a reservoir of deacidifying agent. The polymer film enclosure is capable of enclosing an acidic paper article such that the deacidifying agent is capable of migrating over time to the acidic paper article enclosed therein in an amount sufficient to retard the deterioration rate of the paper. Preferably, the present invention can supply sufficient agent to retard the deterioration rate of acidic paper for at least a year, and more preferably for 20 or more years. The migration of the deacidifying agent occurs for at least about 1 day, more preferably at least about 1 week, even more preferably at least about 1 month, and most preferably, at least about 1 year, or longer.

The barrier can be a polyester film such as polyethylene terephthalate (PET). The layer in communication with the deacidifying agent can be a polyolefin, polyalkylmethacrylate, polyalkylacrylate or co-polymer thereof. Suitable polyolefins include polyethylene.

Preferred deacidifying agents are those having a solubility in the film such that the additive concentrates at the film surface upon cooling or drying after processing the film raw material into a film. Suitable embodiments include a film coating of a polybutylmethacrylate polymer having a molecular weight greater than about 20,000 and which contains from between about 3 percent and about 30 percent by weight of an amino-functional silicone. The term amino-functional is used herein to refer to an amine group as part of the molecular structure. A further embodiment includes a film coating of an aliphatic amine cross-linked epoxide wherein a stoichiometric excess of amine functions as the deacidifying agent.

The polymer film enclosure can be in the form of a book jacket or cover. Further, the deacidifying agent can be contained within a sachet in the enclosure.

In a preferred embodiment, the deacidifying agent has a molecular weight between about 150 and about 5000, and deacidification is effected by migration of the deacidifying agent into the paper article under ambient conditions. The deacidifying agent can include an aliphatic amine having an amine content expressed as NH2, NH, or N from between about 0.5% and about 20% by weight, and a molecular weight of between about 150 and about 1000.

The present invention further includes a method for retarding the deterioration rate of acidic paper including providing a polymer film enclosure having a reservoir of deacidifying agent; and placing an acidic paper article in the polymer film enclosure, wherein the deacidifying agent migrates over time to the paper article in an amount sufficient to retard the deterioration rate of the paper.

In one embodiment, the deacidifying agent reduces the acidity of the paper. In another embodiment, the deacidifying agent deters the formation of acid by the paper.

The method may further include the step of sealing the paper article in the polymer film enclosure.

The method may further include placing a carrier material in the polymer film enclosure, wherein the carrier material includes a second reservoir of deacidifying agent. The carrier material may be a backing or mounting board for the paper article or a mat frame.

Polymer films alone provide some measure of protection of paper articles. As noted above, however, they are not effective in addressing the acid deterioration issue and can in some cases even accelerate this deterioration mechanism. The present invention improves paper preservation by creating an inherently deacidifying environment within the polymer film enclosure, and preferably enlists the polymer film itself as the source for an agent to deacidify the paper. The deacidifying agent can be an additive in the polymer film, or can be applied onto the polymer film, either as a coating or an additive in a coating. The deacidifying agent may also be impregnated into a porous material and placed within the polymer film enclosure along with the paper item needing to be deacidified. The porous material may even be a heavily impregnated piece of paper which serves as a source for the deacidifying agent, which subsequently migrates to the other paper items present in the same film enclosure.

The present invention creates an inherently deacidifying environment within a polymer film enclosure, preferably by using organic or silicone compounds with a minimum molecular weight of 150, but which still exhibit sufficient vapor pressure or surface chemistry properties to be capable of gradual migration into the paper article to effect deacidification. Due to the higher molecular weight of the aliphatic amines used in the present invention as compared to the amines previously employed for paper deacidification, the deacidification can be effected without requiring immobilizing agents as in U.S. Pat. No. 4,927,497. Moreover, the higher molecular weight of the agents of the present invention enables the materials to be pre-compounded into polymer films without excessive process loss due to volatilization. The agents of the present invention (preferably aliphatic amines), which migrate into the paper upon long term ambient conditions, are preferably pre-compounded into the polymer films used for the enclosures. Alternatively the agents can be coated onto the polymer film, or either impregnated into porous materials or coated onto materials which are simply placed within the film enclosure along with the items made from acidic paper. The additives are preferably of sufficient basicity to neutralize the acid that forms upon paper deterioration, and in consequence slow the rate of deterioration. Any thermal increase which would accelerate deterioration would also likely accelerate the migration, and thus to some degree, cancel the adverse effect of the temperature increase. In consequence, the preservation mechanism would be enhanced when most needed.

In other words, a preferred embodiment of the present invention is to compound into a polymer film, or coating on the film, an alkaline compound that is capable of migrating, upon long term storage, into a paper article from the film, or film coating, and effect neutralization of the acid present or formed, thereby preventing or reducing acid deterioration of the paper. In this preferred embodiment the paper article is encased in a polymer film package, and the polymer film is constructed such that the inner surface is enriched with the agent, whereas the outer film layer serves as a barrier to the migration of the agent to the external environment. This can be accomplished by co-extrusion wherein the film is a two or three (three includes a tie-layer) layer film, or by subsequent coating of the inner surface of a single layer film. The polymer inner layer or coating is the carrier for the alkaline agent. Concentration of this compound on the inner surface could be further enhanced by careful selection of the compound based on solubility parameters such that solubility in the polymer is limited, particularly subsequent to processing. The molecular weight of the alkaline additive is also important since the additive should not be excessively lost during compounding/processing, but must be capable of migration into the paper article upon aging. A suitable molecular weight range is between about 150 and about 5000. The exact optimum range for each alkaline compound will differ within this general range. For those that migrate in the vapor phase, the lower end of the range is preferred, but if the molecular weight is too low the compounds will be too volatile to be of practical use in the exercise of this invention. Besides excessive volatility, lower molecular weight compounds can often cause other problems such as odor, toxicity, high diffusion losses through the barrier layer, negative effects on inks and glues present on many paper items, etc.

Loss of the alkaline compounds during storage of film constructed in accordance with the preferred embodiments of the present invention, prior to their use as a protective encasement for paper, is not likely to be a significant problem, because the film will either be stored in rolls, wherein the base-containing layer is sandwiched between two barrier layers, or formed into an encasement sleeve, bag, etc., for which the barrier layer would be the external layer. For these reasons, depending on specific processes employed for film production or coating, faster migrating materials can be more compatible with the film being the carrier, rather than the carrier being a porous sheet or sachet, since in the latter cases some exposure and handling external to the enclosure is to be expected.

Three important properties of alkaline compounds suitable for direct compounding into polymer films or film coatings include sufficient basicity to deacidify the paper, the solubility characteristics in the polymer film or film coating material, and a molecular size that exhibits a satisfactory balance between stability, including process-loss, and migration. If, on the other hand, the compound is impregnated into a porous material, the solubility characteristics are less important. Ideally, however, even here, the compound should be soluble in environmental and user-friendly solvents for the impregnation process.

Suitable alkaline agents include aliphatic amines which may be primary, secondary, or tertiary amines having a molecular weight preferably below about 1000, more preferably between about 150 and about 1000, even more preferably between about 150 and about 500, and most preferably between about 200 and about 300. These include, but are not limited to, alkyl amines, such as di-2(ethylhexyl) amine, dodecylamine, tetradecylamine, and octadecylamine; fatty amines, such as hydrogenated tallow amine; cycloaliphatic amines; ethoxylated and/or propoxylated amines; amino-functional silanes; amino-functional esters, such as amino-functional acrylates; hindered amines (HALS) such as esters of a 2,2,6,6-tetraalkylpiperidinol and mono- or di-aliphatic carboxylic acids containing between 2 and n carbon atoms, and wherein the alkyls on the piperidinyl ring contain from one to four carbon atoms. For esters of mono-carboxylic acids, n is less than 18. For esters from dicarboxylic acids, n is less than 12. An example includes bis(2,2,6,6-tetramethyl-4-piperidinyl) sebacate. The aliphatic amine can also be an amino-functional silicone. In the case for silicones, the molecular weight range can be extended somewhat higher, since migration can occur readily by surface diffusion or wetting, and is not dependent solely on the material vapor pressure. Suitable silicone agents have a molecular weight preferably below about 5000, more preferably between about 500 and about 1500, and most preferably between about 800 and about 1000.

Although a wide range of aliphatic amines would be satisfactory for neutralization of the acid in the paper, and many would migrate to the paper in a polymer film enclosure to accomplish deacidification in the indirect case, only a few will be most highly preferred for use for several aesthetic reasons. Many exhibit irritating vapors and cause skin sensitization problems. Many also cause the papers to discolor. The discoloration can be immediate, or can occur upon aging. It is preferred that the additive itself be stable in the environment over long term aging without discoloration, degradation, or any adverse reaction with the paper, film, or inks thereon. The additives also preferably should not cause an increase in susceptibility of cellulose to biological attack. For this reason many unsaturated organic structures are not preferred candidates. Oleylamine, for instance, would not be preferred, even if it did not discolor the paper, since it can become rancid upon aging.

Included within the scope of deacidifying agents are those agents which act to deter acid formation by the paper. Rather than neutralizing the acid once it is formed, these agents reduce the amount of acid that forms from aging paper. This is an example of an alternative preservation mechanism to acid neutralization. According to this embodiment, the paper is rendered hydrophobic by treatment with compounds that have surfactant molecular structures, which include both hydrophilic and hydrophobic portions. Orientation of these molecular structures on the cellulose fibers, such that the hydrophilic portion is adsorbed onto the surface, can impart a degree of hydrophobicity to the paper which has the potential to further reduce the rate of paper deterioration by excluding moisture from the cellulose structure. Suitable agents which can exhibit this effect include octadecyl amine, octadecyl silane, and amino-functional silicones. This mechanism has the potential to slow the rate of deterioration completely independent of neutralization.

Although a preferred embodiment includes a co-extruded film of two or three layers, or a coated single-layer film, the present invention also includes films of more than three layers, films with multiple coating layers, or even single-layer films, wherein the alkaline additive can migrate to and from both surfaces. Moreover, although clear films are preferred, pigmented films are also included, together with basic additive agents in a particulate form which remain insoluble in the polymer film, or film coating, during and subsequent to processing. The alkaline additive could also be a plurality of additives, and/or could serve a plurality of functions. For example, the additive package could include an alkyl amine and/or bis(2,2,6,6-tetramethyl-4-piperidinyl) sebacate, Tinuvin 770, wherein the Tinuvin 770 co-functions as a neutralizing base for the paper and a UV stabilizer for the polymer.

There is expected to be, of course, a practical limit in the amount of additive that can be transferred from a polymer film to an enclosed paper article. This, in turn, means that there is a practical limit on the size of the paper article that can be treated effectively. The ANSI/NISO paper permanence standard calls for a minimum alkaline reserve of 2%; other references claim a 1% reserve can extend paper life to centuries. The standard, and the prior conclusions based on experience with inorganic carbonates, may not be directly applicable to the materials of this invention, but it is expected that more than a trace amount of additive will need to be transferred in order to be effective, and more than initially needed to neutralize the acid already formed prior to treatment. One option to increase the amount of additive available for books, and to reduce the migration path, is to interleave the pages with sheets of the film. Sheets of the film can be placed between the pages, spaced at a prescribed number of pages apart. A similar approach using paper treated with carbonates recommends that the neutralizing sheets be placed 6 pages apart. Based on results to date, the materials employed in this invention will allow significantly greater spacing. Interleaving is also commonly done for prints, drawings, etc. Glassine and buffered tissue paper are often employed for this purpose. The amino-functional compounds within the scope of this invention can be impregnated into porous materials and easily placed within the polymer film enclosures along with the paper items to be treated. The porous material can be any of a number of inert inorganic materials, or can be felt, cotton, or even paper. In the latter case, heavily impregnated paper sheets could be used to treat other paper sheets placed within the same film enclosure. In fact, backing boards not containing deacidifier are often placed within the polymer protective sleeves along with single paper sheets, pamphlets, or other paper items of insufficient stiffness to resist folding, creasing, etc. during handling. A backing board that co-functions as a stiffener as well a deacidifier would be particularly advantageous for many paper items.

The value of some books, particularly those published in the 20th century, is often dependent on the condition of the cover; in consequence, another option for protection is to form the plastic film into book covers or jackets which would aid in preserving the condition of the underlying paper covers. Bookcovers are particularly vulnerable, because they are on the exterior, where they are exposed to light and atmospheric pollutants, both of which can accelerate deterioration.

EXPERIMENTAL PROCEDURE

Paper is commonly checked for pH using color indicator pens. Chloro-phenol-red is a common indicator that changes from yellow (acid) to purple (alkaline) ("Technical Considerations in Choosing Mass Deacidification Processes", by Peter G. Sparks, in *Advances in Preservation and Access*, edited by Barbra Higginbotham and Mary Jackson, Meckler, 1992). Various papers were tested for acidity using pH pens from three different vendors. All three pens gave similar results in terms of identifying acidic papers. The pH pen from Fiskars (#2649) was selected for additional testing because the color changes were the easiest to distinguish. There was also excellent agreement between different Fiskars pens, although there was some variability in the rate of color change. Based-on the information printed on the package as-supplied by Fiskars, the indicator used in these pens is yellow or colorless below about pH 6, tan between pH 6 and 6.7, and purple above about pH 6.8. These pens appear to give similar results in terms of color change vs. pH to pens 3, 4 and 5 in the study done on commercial pH pens by J. Miller and E. McCrady which was published in the Alkaline Paper Advocate in 1990 ("Comparison of pH Pens on the Market", by J. Miller and E. McCrady, Alkaline Paper Advocate, v. 3, no. 5, November 1990). Based on their study, the indicator is yellow up to about pH 5, then yellow-brown about pH 6, brown at pH 7, purple-brown at pH 8, and purple above about pH 9. The transition from yellow to tan with the Fiskars pens does go through a yellow-tan region, and the transition from tan to purple goes through first a purple-tan region, followed by light purple which darkens at higher pH. On very acidic papers, the yellow lightens and becomes almost invisible. Although relying on the pH pens does not give a precise pH, it is clear from the above that, for the pens used in the following tests, colorless pen marks indicate high acidity, yellow marks indicate acidity up to about pH 6, yellow-tan marks indicate about pH 6, tan marks indicate very slight acidity to near neutral, purple-tan marks indicate near neutral to slightly basic, and purple marks indicate basic, with the darker purple likely indicating a pH of about 8.5 or greater.

The paper selected for most tests was taken from PRO-0220-03 newsprint tablets, manufactured by Pro Art, Beaverton, Oreg. Other papers tested included paper from #2603-058 Doodle Pad/Blocs, manufactured by the Horizon Division of Spiral Paper, Canada, and Artist's Sketch Pads, manufactured by Dutton LeBus Paper, Rancho Cucamonga, Calif. Tests were also conducted on year 2000 editions of printed newspaper taken directly from the Wellsboro, Pa. *Advertiser*, or the Rochester, N.Y. *Democrat and Chronicle*, as well as on newspaper from an old 1877 edition of *The Culivator and Country Gentleman*. Other old embrittled papers were taken from various sources which included: a novel, entitled *Wormwood*, by Marie Corelli, published by Federal Book Co. in 1903, old Street and Smith paperback books published circa 1900, *Mother Goose's Nursery Jingles* published by Hurst Co. circa 1900, and *Noble Lives and Brave Deeds* published by Cassell Publishing circa 1890. All of these papers resulted in yellow marks when tested with Fiskars pH pens, with the marks on the aged paper being so light as to be almost invisible.

Since it is well known that many amines cause unacceptable paper discoloration (*Mass Deacidification of Paper*, by Astrid-Christiane Brandt, Bibliotheque Nationale, 1992), the selected aliphatic amines were first tested for direct treatment on paper to confirm they would deacidify paper without adverse effects, such as discoloration. If they performed satisfactorily they then were tested for their ability to deacidify paper indirectly by migration. Initially the following amines with molecular weights in the 150 to 5000 range were tested as direct paper treatments: dodecylamine, tetradecylamine, hexadecylamine, and octadecylamine all from Aldrich Chemical Co.; Tinuvin 770F from Ciba-Geigy; Armeen 16D and Ethomeen 18/60 from Akzo Nobel Inc.; Ancamine 2143 from Air Products Inc.; Sipamine TAM-2 and Sipamine TAM-15 from Specialty Industrial Products Inc.; Silquest A-1100 and Silquest A-1170 from OSi Specialties Inc.; and, DMS-A11, DMS-A12 and AMS-132 from Gelest Inc. The Armeen 16D is an industrial grade alkylamine. The Ethomeen and Sipamines are ethoxylated alkylamines, with the Ethomeen having the highest degree of ethoxylation and the Sipamine TAM-2 the lowest. The Silquests are amino-functional silanes. The Ancamine is an aliphatic diamine. The Tinuvin is a hindered amine light stabilizer (HALS). The DMS and AMS materials are amino-functional silicones. Later the amine list was expanded to include: USB 9912 from Gelest Inc.; GP-134, GP-4, GP-7105, GP-7104, and EXP-61 from Genesee Polymers; and, SF 1921 from G.E. Silicones. These latter materials are amino-functional silicones, and were added based on the initial promising results with DMS-A11 and DMS-A12. The USB 9912 is also a hindered amine.

The amines were dissolved in a solvent and treatment of the paper was done by immersion followed by drying. Amine concentrations in the solvent varied, but for direct treatment remained in the 1% to 10% by weight range, with the higher percentages being used for materials with lower amine content.

Initially the polymer sleeves used for the tests were 2 mil polyethylene, but later, due to the need for lower permeability, 3 mil polyester film was used. The polyethylene sleeves used for encasement were 2 mil polyethylene bags purchased from Larry E. Krein Company. The polyester sleeves were 3 mil #7165 Mylar envelopes from Light Impressions. The polyethylene sleeves were heat-sealed at the open end, whereas the Mylar envelopes were tape sealed with 3M Photo & Document Mending Tape. Polyester sheet film was also tested. Both 3 mil #2290 polyester film from Light Impressions, Rochester N.Y., and 3 mil polyethylene-coated polyester film from Poly Lam Products Corporation, Williamsville, N.Y. were used. The latter film was heat sealed, whereas the #2290 film was sealed with adhesives. Adhesives used were either the 3M Photo & Document Mending Tape, or #415 Film Tape from Light Impressions.

In the indirect treatment case various papers were tested as carriers for the treatment material. Initially both the acidic 0220 paper and a non-acidic, lignin-free card stock were used, but the preferred paper carrier was unbuffered blotting paper from The Memorabilia Corner, Norman, Okla. The carrier paper was treated by impregnation (immersion), followed by drying. Higher concentrations (5% to 30%) of the amine were used for carrier impregnation in the indirect case than for direct treatment.

The treated carrier sheets were sealed in the polymer sleeves with untreated paper sheets. They were either placed to the rear with the treated sheets in front, or in the center with untreated sheets on both sides. Another configuration used was to place the untreated sheets in order of incrementally decreasing lengths in front of the treated sheet. This configuration allowed a pH pen mark to be viewed from the front through the transparent bag across multiple layers of untreated sheets. It was found that the indicator in the Fiskars pens was sufficiently stable such that the pens could be used to indicate pH changes during aging. There was good agreement between the color of the original pen marks and the marks freshly made after aging. A notable exception to this was aging by exposure to sunlight. When the pH pen marks were exposed to sunlight, the color became photobleached such that the marks no longer could be used as indicators of pH.

The commercial deacidification materials used for comparison purposes were Wei T'o solutions no. 2 and no. 4, and Bookkeeper deacidification spray. All three of these materials were purchased from University Products Inc., Holyoke, Mass. Wei T'o solution no. 2 is methoxy magnesium methyl carbonate in a Freon solvent, and Wei T'o solution no. 4 is ethoxy magnesium ethyl carbonate in ethanol.

Aging at elevated temperatures (from about 60° C. to about 100° C.) and by exposure to UV light have been widely used to provide an indication of the paper's resistance to aging under natural conditions ("Artificially Accelerated Aging of Paper", by R. R. Yabrova, in *Collection of Materials on the Preservation of Library Resources*, Israel Program for Scientific Translations; "Aging of Paper", by T. A. Pravilova, in *New Methods for Restoration and Preservation of Documents and Books*, Israel Program for Scientific Translations). The correlation has been reasonably good, provided the humidity is kept higher than about 60% ("Aging of Paper", by T. A. Pravilova, in *New Methods for Restoration and Preservation of Documents and Books*, Israel Program for Scientific Translations). As paper ages the acidity increases, and the paper becomes weakened and brittle. The physical property changes are due to changes in the structure of cellulose, which includes chain length reduction, increased cross-linking, and increased crystallinity. Paper color changes may, or may not, correlate with the physical property changes, since it is the lignin, and not the cellulose, that dominates the changes in color. Often deacidified paper discolors as much, or more, than untreated paper ("Yellowing of Newspaper after Deacidification with Methyl Magnesium Carbonate", by Vladimir Bukovsky,

*Restaurator*, vol. 18, 1997). In these results the effects of aging were determined by changes in acidity. As described in the results, both temperature and UV light (as present in sunlight) were employed as means to accelerate aging.

Although most of the amino-functional materials readily deacidified paper, as noted above many were not preferred for practical use due to discoloration of the paper and/or irritating vapors. Some, such as the amino-silanes and the diamine, Ancamine 2143, severely discolored the PRO-0220-03 paper. Many, such as all the alkyl amines and the Ancamine 2143, had irritating vapors. Others, such as the higher ethoxylated amines, did not adequately deacidfy the papers, especially the highly acidic aged papers. Those amines that adequately deacidfied the papers as direct treatments, and which did not severely discolor the PRO-0220-03 paper, were tested for their potential to deacidify paper by migration. Initially this was done by placing treated sheets superjacent to untreated sheets and heat sealing the papers in polyethylene sleeves. These samples were then aged in a dark warm environment at about 35 C. Several of the alkyl amines and the amino-functional silicones readily deacidfied the superjacent untreated paper. For dodecylamine the deacidification occurred rapidly, but the vapors were found to be irritating; moreover, polyethylene was found to be quite permeable to this amine, so much so that it was found that dodecylamine could even cause neutralization of acidic papers in superjacent sealed polyethylene bags. In other words, the dodecylamine was able to migrate through two layers of 2 mil polyethylene. All of the alkyl amines exhibited the same effects, although as expected the rate of indirect deacidification and permeability declined with increasing molecular weight. Ethoxylation reduced the irritating vapors, and the permeability through polyethylene, but not to an acceptable level except at high levels of ethoxylation which also reduced the ability to deacidfy the paper. The best overall characteristics were clearly exhibited by the amino-functional silicones, in particular DMS-A11. The amino-functional silicones did not cause significant discoloration of the paper, and did not exhibit irritating vapors or objectionable odor. Some of the higher molecular weight amino-functional silicones, on the other hand, caused the paper to become non-adhering to pressure-sensitive tapes; but, the DMS-A11 did not, except at much higher concentrations than necessary to deacidfy the paper. The DMS-A11 is an amino-terminated dimethylsiloxane in the molecular weight range of 800–1000. It clearly exhibited the characteristics necessary for the practical implementation of this invention. The weight percent amine (as NH2) is between 3.2 and 3.8. A slightly different grade, DMS-A12, with higher molecular weight and lower percent amine, also functioned satisfactorily, but was less effective and more prone to exhibiting the tape adherence problem. Tape adherence may not be a problem for some applications, but ideally the treated paper should not exhibit any change in properties except a reduced deterioration rate. An aminopropylmethylsiloxane-dimethylsiloxane copolymer, AMS-132, was even less effective for indirect deacidification, and very much worse in regard to tape adherence.

Because of the good results with DMS-A11, additional amino-functional silicones were tested to determine if any also exhibited satisfactory characteristics for the practice of this invention. One additional silicone, GP-4 from Genesee Polymers, did function satisfactorily, and, in consequence was included in further tests. This amino-functional silicone is much higher in molecular weight than DMS-A11, such that migration likely occurs by surface diffusion/wetting or capillary action; moreover, permeability, even through polyethylene, is low. The amine number of GP-4 is 90.

DMS-A11 deacidified all papers immersed in solutions of this material. Solution concentrations varied from 0.5 ml per 25 ml solvent to 2.5 ml per 25 ml solvent for direct treatment. For indirect treatment solution concentrations for treating a carrier were in the range from 1 ml per 25 ml solvent to 10 ml per 25 ml solvent. The solvent used for DMS-A11 was hexane or heptane. When treated papers were sealed in polyethylene sleeves with untreated paper, the untreated paper became deacidified upon aging under ambient conditions as determined by the pH pens from Fiskars. Unlike in U.S. Pat. No. 5,433,827 there are no special pressure or humidity conditions necessary for the deacidification of adjacent sheets to occur. In this case the items simply need to be placed in the same polymer film enclosure; however, if not placed in a polymer film, or other low permeability enclosure, the silicones migrate gradually from the paper article to the environment or adjacent items. It is not practical to expect that the same materials would be ideal for both the direct and indirect treatment cases. The direct treatment case requires stability, meaning immobility, in a wide variety of potential environments. The enclosure must exhibit low permeability for the deacidifying material in the indirect case. Dodecylamine, as noted above, is a very fast acting indirect deacidifier, but many of the commonly used polymers, such as polyethylene, exhibit high permeability for this amine such that it is quickly lost from the enclosure upon aging. The polyethylene terephthalate (PET) film is a more effective enclosure for long term aging than polyethylene.

Low molecular weight silicones are employed as additives in polymer compounding to function as internal release, or slip agents. It is expected, therefore, that the DMS-A11 material will exhibit the characteristics necessary for being directly compounded into the polymer films. Due to limited solubility in the common film polymers it is expected that the silicone will concentrate at the film surface, and thereby perform as envisioned in the preferred embodiment of this invention, and as demonstrated in an example using an acrylic film coating. It is actually quite fortuitous that the amino-functional silicones were found to be satisfactory materials for indirect deacidification, since the amino-functional silicones are less toxic, less irritating, less odorous, and more light stable than the hydrocarbon amines. Their low surface tension also facilitates migration due to surface diffusion or wetting.

The currently used commercial deacidifying agents were evaluated to determine if they could deacidify paper indirectly, but neither Wei T'o nor Bookkeeper treatments caused superjacent papers placed in the polymer film enclosures to become non-acidic under any of the test conditions employed.

One significant advantage of indirect treatment is that no solvents are involved in the treatment process. The user does not need to handle solvents. Detrimental solvent effects on the treated article are avoided. In contrast, in the case of treating paper directly rather than indirectly, the solvents employed can have an effect on the results, particularly paper discoloration. Lignin, being soluble in the more polar solvents, plays a key role in this discoloration. The inks, in particular, are sensitive to the solvents employed, and even a small amount of a polar solvent, such as an alcohol, can have detrimental effects. Solvents, including water, can also cause wrinkling or staining of the paper. Low polarity hydrocarbon solvents, and certain fluorocarbon solvents are preferred as treatment solvents because of minimal deleterious effects on the paper or the inks thereon. Of course, in the indirect treatment case the solvent characteristics are only relevant to the film coating or carrier impregnating processes, since the intent is not to have solvent present at the time of paper treatment. It is a very significant advantage of indirect treatment that no solvents are involved in the treatment process. If the silicones are to be applied from solution as a coating to a film, or as an additive in a coating on the film, then it is further advantageous that the silicones are readily compatible with hydrocarbon solvents such as hexane and heptane, because these solvents are relatively non-hazardous and readily available. The silicones are also compatible with the more recent commercial types of halogenated solvents, such as Oxsol 2000 and Oxsol 100 from Occidental Chemical Corporation. These latter solvents are neither hazardous air pollutants, suspected carcinogens, nor ozone depleting chemicals as are many of the halogenated solvents. In consequence, fabricators can use environmentally friendly solvents.

In order to visually demonstrate indirect treatment, several sample configurations were employed. The first as noted above was to place untreated sheets superjacent to one another in order of decreasing size upon a treated backing sheet. Another was to cut the carrier sheet as a frame and place it superjacent to an untreated sheet. Yet another was to simply place a carrier sheet in the middle of a stack of untreated sheets. If the carrier were a material that could hold a relatively large quantity of base, such as felt or foam, then it could simply be placed anywhere in the same sealed enclosure. In all of these cases the pH pens made markings that visually tracked the progress of deacidification. The markings which were initially yellow on acidic papers change to tan then to purple as deacidification progresses.

In test samples marked with pH pens as noted above, progressive deacidification by dodecylamine occurs throughout superjacent paper layers encased in polyethylene sleeves in a matter of days at ambient temperatures. Dodecylamine, having a molecular weight of 185, represents an intermediate example between the lower molecular weight amines, such as cyclohexylamine carbonate used in the Interleaf process (*Mass Deacidification of Paper*, by Astrid-Christiane Brandt, Bibliotheque Nationale, 1992; "Book Preservation Technologies", Congress of the United States, Office of Technology Assessment, U.S. Printing Office, 1988), and the more stable, less volatile materials preferred for this invention. The intent in this invention is for deacidification to occur gradually during normal ambient aging simply by the deacidifying agent being encased along with the acidic paper, but it is essential that the deacidifying materials not be so volatile as to become lost prior to encasement, and the deacidifying materials should not be irritating or even identifiable by odor upon eventual removal of the paper article from the encasement. DMS-A11 meets these requirements. DMS-A11 deacidifies more slowly than dodecylamine, and materials, such as the GP-4 and DMS-A12 silicones, much more slowly. In the following examples, the effectiveness of the more gradual indirect deacidification was clearly demonstrated, and even the highly acidic aged paper sheets from the hundred plus year old publications could be deacidified in this manner.

EXAMPLE 1

An untreated PRO-0220-03 paper sheet was placed on top of a treated PRO-0220-03 paper sheet and heat sealed in a 2 mil polyethylene sleeve. The treatment was by immersion followed by drying, and concentrations were 1.25 grams active material per 25 ml solvent for dodecylamine, tetradecylamine, hexadecylamine, and octadecylamine, and 2.5 grams active material per 25 ml solvent for Tinuvin 770 DF, Sipamine TAM-15, DMS-A11, DMS-A12, and AMS-132. The solvent was a 7:3 blend by volume of methanol:heptane for all except the amino-functional silicones which used hexane as the solvent. Both paper layers were marked with a Fiskars pH pen. There were 3 samples per condition. Initially all treated paper sheets gave a purple mark and all untreated sheets gave a yellow mark. After 17 days in an attic which reached peak daytime temperatures up to 40 C, the marks on the untreated sheets showed the following:

| Treatment Condition | Pen mark color |
|---|---|
| octadecylamine | purple-tan |
| hexadecylamine | purple-tan |
| tetradecylamine | purple |
| dodecylamine | purple * |
| Tinuvin 770DF | yellow |
| DMS-A11 | purple |
| DMS-A12 | purple |
| AMS-132 | tan |
| Sipamine TAM-15 | yellow |

* had turned purple in less than 24 hours.

EXAMPLE 2

Pro-0220-03 paper was cut 3.5 inches wide and in 0.5 inch increments in lengths up to 6 inches. The paper sheets were placed superjacent to one another in a stepwise manner such that the layers ranged from 1 to 12. The sheets were held in place by a small drop of Lineco neutral pH adhesive in one corner of each sheet. A line was drawn across all 12 sheets with a Fiskars pH pen. A blotter paper backer was cut 3.5 by 6 inches and treated by immersion followed by drying with DMS-A11 in hexane. Concentrations of 5 ml DMS-A11 per 25 ml solvent and 10 ml DMS-A11 per 25 ml solvent were tested. The PRO-0220-03 sheets were placed with the 6 inch long sheet against the backer. The sheets and backer were then placed together between two sheets of 3 mil #2290 Mylar film. The film was edge sealed just outside the paper area with 0.25 inch wide #415 film tape. The samples were then aged for 4 months in an attic as above from August through November. Inspection of the samples at the end of August showed the pH pen mark had turned purple on the first four layers for the higher concentration, and on the first two layers for the lower. Layers 8 through 12, and 5 through 12, respectively, were still yellow. The intermediate layers showed the purple to yellow transition through tan. At the end of four months, the higher concentration was purple up to 8 layers, and the remaining layers were purple-tan. On the lower concentration sample the purple color had progressed up through 5 layers, and layers 10 through 12 were still yellow. Again the intermediate layers showed a transition through tan.

EXAMPLE 3

Samples were prepared as for example #2, except the maximum length was 5 inches and the number of superjacent layers was 10. The DMS-A11 and GP-4 concentrations for treating the backers were 5 ml in 25 ml hexane. The Tinuvin 770 concentration for the backer treatment was 5 ml in 25 ml Oxsol 2000. Control samples were prepared similarly for Bookkeeper and Wei T'o #2 solution. Five samples were also prepared for which the backers were not treated with a deacidfying material. Three samples were made for each treated backer condition, but each was encased differently. One was heat sealed in 3 mil polyethylene coated PET. One was sealed in a 3 mil #7165 Mylar envelope which was tape sealed along the open end with 3M Photo & Document Mending Tape. The remaining sample was sealed between two 3 mil sheets of #2290 Mylar Type D film which were bonded with #415 film tape and edge sealed with the 3M Photo & Document Mending Tape. Unless noted, the manner of sealing did not affect the results. All samples were heat aged at 80 C for 100 hours under conditions of high humidity (an open beaker of water was maintained in the oven throughout the test). All layers were marked before and after the aging with Fiskars pH pens. The original and fresh marks did not give significantly different results, and all samples for the same conditions gave the same results. The results were as follows:

| Backer Treatment | Initial pH pen mark | Final pH pen mark |
|---|---|---|
| None | all layers yellow | all layers yellow |
| Wei T'o #2 | all layers yellow | all layers yellow |
| Bookkeeper | all layers yellow | all layers yellow |
| DMS-A11 | all layers yellow | purple @ 1 to purple-tan @ 10 |
| GP-4 | all layers yellow | tan @ 1, yellow 4 through 10 |
| Tinuvin 770 | all layers yellow | tan @ 1, yellow 4 through 10 |

DMS-A11, GP-4 and Tinuvin 770 showed a gradual transition across the layers which varied from dark purple to a purple-tan for DMS-A11. The transitions for GP-4 and Tinuvin 770 were across layers 2 and 3. The paper had darkened slightly for the DMS-A11 condition, especially for the layers having dark purple marks. Although the Tinuvin 770 shows potential for indirect deacidification, a more volatile HALS than Tinuvin 770 would be preferred for optimum indirect deacidification.

EXAMPLE 4

PRO-0220-03, #2603-058, and Artist's Sketch Pad paper samples were cut 2 inches by 4 inches. Blotter paper was also cut to the same size and treated with deacidfying solutions as above for example #3. The DMS-A11 was tested at both the 5 ml per 25 ml solvent and 10 ml per 25 ml solvent concentrations. The backers were placed in the center with layers of test papers on both sides with a pH pen mark in the center of the outer layers. Two samples per treatment condition having four untreated sheets on each side of the backer were made and sealed differently. One was heat sealed in 3 mil polyethylene-coated PET, and the other was heat sealed in 2 mil polyethylene. For the PRO-0220-03 paper only, samples were also made with 2 and 8 sheets per side. Since no change was expected for the control conditions (no treatment, Wei T'o #2, & Bookkeeper) samples of these were only made with PRO-0220-03 paper at two sheets per side. The samples were aged for four months as for example #2. All pH pen marks were initially yellow. The results (pH pen color for paper type/# layers) after 4 months were as follows:

| Treatment Condition | 0220/2 | 0220/4 | 0220/8 | 2603/4 | ASP/4 |
|---|---|---|---|---|---|
| none | yellow | — | — | — | — |
| Wei T'o #2 | yellow | — | — | — | — |
| Bookkeeper | yellow | — | — | — | — |
| DMS-A11 @ 10 ml | purple | purple | tan | purple | purple |

-continued

| Treatment Condition | 0220/2 | 0220/4 | 0220/8 | 2603/4 | ASP/4 |
|---|---|---|---|---|---|
| DMS-A11 @ 5 ml | purple | purple | yellow | purple | Purple |
| GP-4 @ 5 ml | — | yellow | yellow | yellow | tan |

DMS-A11 had deacidified all papers up to four layers per side for both concentrations, but only the higher concentration had reached the eighth layers. GP-4 had only deacidfied up to four layers for the least acidic paper.

The DMS-A11 conditions with 2 layers of PRO-0220 paper per side were also tested using backers that had been stored in an unsealed polyethylene bag after treatment for about one month. This was done to determine if the treated backers had lost their effectiveness. When inspected a week after encasement in adhesive PET, the pH marks on the PRO-0220 paper were already purple.

EXAMPLE 5

PRO-0020-03 paper was cut into 2 inch by four inch samples. Two sheets were then assembled with one folded upon the other to create one, two and three layer areas. The samples were then placed upon treated blotter paper backers as in examples #2 and #3 above and heat sealed in polyethylene coated PET. The same backer treatment conditions were used as for example #4. In this case the encased samples were placed in pockets on a test panel such that one half of the sample was masked from light and one half was exposed. The test panel was constructed from black construction paper, and the entire panel was placed in a 3 mil polyethylene sleeve to protect it from the weather. The panel was then placed outdoors facing south and exposed to normal outdoor conditions for 3 months from August through October. The panel was taped along the edges to hold it in place against a rigid metal sheet. All samples were marked with a Fiskars pH pen, but the marks became near invisible during the exposure. At the end of the aging test the samples were removed from the enclosure and remarked. The results (pH pen color for exposure/# layers) are as follows:

| Treatment Condition | masked/1 | masked/3 | exposed/1 | exposed/3 |
|---|---|---|---|---|
| none | yellow | yellow | yellow | yellow |
| Wei T'o #2 | yellow | yellow | yellow | yellow |
| Bookkeeper | yellow | yellow | yellow | yellow |
| DMS-A11 @ 5 ml | purple | purple | tan | yellow |
| DMS-A11 @ 10 ml | purple | purple | purple | tan |
| GP-4 @ 5 ml | tan | yellow | yellow | yellow |

The DMS-A11 samples did exhibit some discoloration, especially in the exposed areas.

EXAMPLE 6

PRO-0220-03 paper samples were cut 3.5 inches by 6 inches. Blotter paper was cut to create a 0.5 inch frame around these paper sheets leaving an uncovered area of 2.5 inches by 5 inches. A Fiskars pH pen was then used to mark the uncovered region with lines and a center dot, such that progress of any deacidification outward from the frame could be easily discerned. The frame was treated as for Examples # 3, #4 and #5 above. Two samples for each treatment condition were made, one sealed in 2 mil polyethylene, and one in polyethylene coated PET. Unless noted results were identical for both sealing conditions. The samples were aged as for Examples 2 and 4. After aging the results (pH pen color listed under inspection date and encapsulating film) were as follows:

| Treatment Condition | 8/31 PE | 8/31 PE/PET | 12/11 both films |
|---|---|---|---|
| none | yellow | yellow | yellow |
| Wei T'o #2 | yellow | yellow | yellow |
| Bookkeeper | yellow | yellow | yellow |
| DMS-A11 5 ml | yellow | tan | light purple * |
| DMS-A11 @ 10 ml | tan | light purple | purple |
| GP-4 @ 5 ml | yellow | yellow | yellow-tan |

* darker for PE/PET film condition

EXAMPLE 7

As has been noted, ideally one would prefer an indirect deacidification process that could treat large multi-page books solely through enclosure in a deacidifying film or with a single sheet of a carrier for the deacidifying agent. Practically, however, due to limitations on the quantity of agent that can be incorporated into the film or carrier sheet, this technique is most useful for flat paper items of which there are a great variety needing preservation ("Paper: Manuscripts, Documents, Printed Sheets, and Works of Art", by Karl Buchberg, in *Conservation in the Library*, edited by Susan Garretson Swartzburg, Greenwood Press, 1983). This example clearly demonstrates the usefulness for deacidfying such items through the practice of this invention by encasement along with a single carrier sheet in a polymer film enclosure.

The following papers were encased in polymer films on backing sheets of blotter paper prepared as for examples #2 and #3 above. Two sheets for each paper were placed on the blotter backer, except for the old papers and prints for which only single sheets were used. Blofter treatment solution concentration was 15% deacidifying agent by volume in heptane, except for tetradecyl amine which was 1 gram in 29 ml solvent (24 ml heptane, 5 ml Oxsol 2000). The encased samples were aged for 60 hours at 70 C in an oven which also contained an uncovered beaker of water. The PET films were edge sealed with 3M Photo & Document Mending Tape, and the PE films were heat sealed. All pH pen marks were initially yellow. The papers tested were: PRO-0220, Artist Sketch Pad (ASP), Doodle Pad #2603, printed newspaper (Dec. 3, 2000, Rochester *Democrat & Chronicle*), old printed newspaper (Sep. 27, 1877 *Cultivator and Country Gentleman*), old paper from *Wormwood,* old paper from a 1902 Street & Smith paperback, an old print from *Mother Goose's Nursery Jingles* published circa 1900, and an old print from *Noble Lives and Brave Deeds* published circa 1890.

After 60 hours the results were as follows:

| paper | film | deacidifying agent | pH pen color |
|---|---|---|---|
| PRO-0220 | PET | tetradecylamine | purple |
| PRO-0220 | PET | DMS-A11 | purple |
| PRO-0220 | PET | DMS-A12 | tan |
| #2603 | PET | DMS-A11 | purple |
| ASP | PET | DMS-A11 | purple |
| 2000 newspaper | PET | DMS-A11 | purple |
| 1877 newspaper | PET | DMS-A11 | purple |

-continued

After 60 hours the results were as follows:

| paper | film | deacidifying agent | pH pen color |
|---|---|---|---|
| Wormwood | PET | DMS-A11 | light purple |
| M.G.N.J. print | PET | DMS-A11 | tan |
| N.L. & B.D. print | PET | DMS-A11 | purple-tan |
| old S&S paper | PET | DMS-A11 | light purple |
| PRO-0220 | PE | none | yellow |
| PRO-0220 | PE | DMS-A11 | purple |
| PRO-0220 | PE | DMS-A12 | tan |
| PRO-0220 | PE | Wei T'o #2 | yellow |
| PRO-0220 | PE | Wei T'o #4 | yellow |
| PRO-0220 | PE | Bookkeeper | yellow |

PE = 2 mil polyethylene
PET = #2290 Mylar

EXAMPLE 8

This example demonstrates the usefulness of this invention for deacidifying paper items by enclosure within a polymer film that contains a deacidfying agent. Moreover, the example demonstrates the ability of amino-functional silicones to concentrate at surfaces due to their solubility characteristics in the film or film coating. In this example the DMS-A11 is soluble in the film coating formulation while the solvent is present, but during drying the DMS-A11 becomes at least partially insoluble such that it separates from the film-forming polymer and concentrates at the surface giving the surface a very slight oily feel. The film coating becomes slightly hazy when dry, indicating that some of the DMS-A11 is retained within the coating as a dispersed second phase.

#2290 Mylar sheet was blade coated with coating solution A.

Coating Solution A: 1 ml DMS-A11, 4 grams Elvacite 2045, 50 ml 4:1 heptane:Oxsol 2000

Coating Solution B: 0.75 ml DMS-A11, 4.25 grams Elvacite 2045, 50 ml 4:1 heptane:Oxsol 2000

The dried coating thickness was about 0.5 mil. After drying, the film was used to encase PRO-0220 paper. The edges were sealed with 3M Photo & Document Mending Tape. Aging was done in an oven as for example #7. Initially the pH pen marks on the paper were yellow, but after 60 hours at 70 C the marks were purple-tan.

Additional Mylar sheets were coated as above for both Coating A and Coating B. Prints were cut from *Mother Goose's Nursery Jingles,* and *Noble Lives and Brave Deeds,* and encased in the coated Mylar sheets exactly as above. The coated side was placed towards the paper print on both sides. The film was cut slightly oversize and the edges were sealed with 3M Photo and Document Mending Tape. Although the coating did exhibit a slight haze, it appeared very transparent when dried in a thin layer on the Mylar, and the haze was not visually apparent when the prints were viewed through the coated films. Both dried coatings had a slightly oily feel due to the exudation of DMS-A11, but this was almost imperceptible for Coating B. The dried coatings were about 1 mil. The encased prints were simply aged in a warm (25–30 C) room for one month. Prints taken from the same books were aged simultaneously in an uncoated Mylar envelope. All prints were marked with the Fiskars pH pens. After one month the pH pen marks were observed to be as follows:

| Print | Coating on Mylar | pH pen marks |
|---|---|---|
| N.L. & B.D. | None | yellow |
| M.G.N.J. | None | yellow |
| M.G.N.J. | A | purple-tan |
| N.L. & B.D. | A | light purple |
| M.G.N.J. | B | tan |
| N.L. & B.D. | B | tan |

There was no perceptible difference in the visual appearance of the paper itself between the prints aged in the coated Mylar and the prints aged in uncoated Mylar.

What is claimed is:

1. An article for retarding the deterioration rate of acidic paper comprising:

a polymer film enclosure comprising a reservoir of deacidifying agent and, at least one barrier layer that substantially inhibits the migration of the deacidifying agent from within the polymer film enclosure, said polymer film enclosure enclosing an acidic paper article, wherein the deacidifying agent migrates over time to the acidic paper article enclosed therein in an amount sufficient to retard the deterioration rate of the paper wherein the deacidifying agent comprises an alkyl amine, a cycloaliphatic amine, an amino-functional ester, an amino-functional acrylate, an amino-functional silicone, an alkoxylated amine, an ethoxylated hydrogenated tallow amine, a hindered amine, or a polyamine.

2. The article of claim 1, further comprising an acidic paper article enclosed in the polymer film.

3. The article of claim 1 wherein said reservoir of deacidifying agent comprises a coating on the polymer film.

4. The article of claim 1, wherein said reservoir of deacidifying agent is incorporated as an additive in a coating on the polymer film.

5. The article of claim 4, wherein the additive solubility in the film coating is such that the additive concentrates at the film coating surface upon cooling or drying after processing the film coating on the film.

6. The article of claim 4, wherein the film coating comprises a polybutylmethacrylate polymer having a molecular weight greater than about 20,000 and which contains from between about 3 percent and about 30 percent by weight of an amino-functional silicone.

7. The article of claim 4, wherein the film coating comprises an aliphatic amine cross-linked epoxide and the deacidifying agent comprises an aliphatic amine.

8. The article of claim 1, wherein the polymer film comprises a multi-layered film wherein at least one layer serves as a barrier against loss of the deacidifying agent from the enclosure to the outer environment, and at least one layer contains the deacidifying agent.

9. The article of claim 8, wherein the layer containing the deacidifying agent comprises a polyolefin, polyalkylmethacrylate, polyalkylacrylate or co-polymer thereof.

10. The article of claim 9, wherein said polyolefin comprises polyethylene.

11. The article of claim 8, wherein the additive solubility in the film is such that the additive concentrates at the film surface upon cooling or drying after processing the film raw material into a film.

12. The article of claim 1, wherein the barrier comprises a polyester film.

13. The article of claim 12, wherein the polyester film comprises polyethylene terephthalate (PET).

14. The article of claim 1, wherein the polymer film enclosure is in the form of a book jacket or cover.

15. The article of claim 1, wherein said deacidifying agent comprises a molecular weight between about 150 and about 5000, and wherein deacidification is effected by migration of the deacidifying agent into the paper article under ambient conditions.

16. The article of claim 1, wherein the deacidifying agent comprises an amino-functional organic material having an amine content expressed as NH2, NH, or N of between about 0.5% and about 20% by weight, and a molecular weight of between about 150 and about 1000.

17. The article of claim 1, wherein the deacidifying agent is contained within a sachet.

18. The article of claim 1, wherein said reservoir of deacidifying agent comprises a carrier material in the polymer film enclosure.

19. The article of claim 1, wherein said deacidifying agent is capable of reducing the acidity of the paper.

20. The article of claim 1, wherein said deacidifying agent is capable of deterring the formation of acid by the paper.

21. The article of claim 1, wherein the time is at least about 1 day.

22. The article of claim 1, wherein the time is at least about 1 week.

23. The article of claim 1, wherein the time is at least about 1 month.

24. The article of claim 1, wherein the time is at least about 1 year.

25. The article of claim 1, wherein the deacidifying agent is an alkaline material.

26. The article of claim 1, wherein the deacidifying agent comprises an aliphatic amine.

27. The article of claim 1, wherein the deacidifying agent comprises an alkyl amine containing between 12 and 30 carbon atoms.

28. The article of 27, wherein the alkyl amine is dodecylamine, tetradecylamine, hexadecylamine, or octadecylamine.

29. The article of claim 1, wherein the deacidifying agent is a hindered amine.

30. The article of claim 29, wherein the hindered amine is an ester of 2,2,6,6-tetraalkylpiperidinol and a mono-aliphatic carboxylic acid containing from 2 to 17 carbon atoms or a di-aliphatic carboxylic acid containing from 2 to 11 carbon atoms, wherein the alkyls on the piperidinyl ring contain from one to four carbon atoms.

31. The article of claim 1, wherein the deacidifying agent is an amino-functional silicone.

32. The article of claim 31, wherein the amino-functional silicone is a aminoalkyl-terminated polydimethylsiloxane or a aminoalkylmethylsiloxane-dimethylsiloxane co-polymer.

33. The article of claim 32, wherein the aminoalkyl is aminopropyl.

34. The article of claim 1, wherein the deacidifying agent comprises an amino-functional silicone having a molecular weight below about 5000.

35. The article of claim 34, wherein the molecular weight is between about 500 and about 5000.

36. The article of claim 34, wherein the molecular weight is between about 500 and about 1500.

37. The article of claim 35, wherein the molecular weight is between about 800 and about 1000.

38. The article of claim 1, wherein the deacidifying agent comprises an aliphatic amine having a molecular weight below about 1000.

39. The article of claim 38, wherein the molecular weight is between about 150 and about 1000.

40. The article of claim 38, wherein the molecular weight is between about 150 and about 500.

41. The article of claim 38, wherein the molecular weight is between about 200 and about 300.

42. The article of claim 1, wherein the deacidifying agent comprises an aliphatic amine having an amine content expressed as NH2, NH, or N of between about 0.5% and about 20% by weight, and a molecular weight between about 150 and about 5000.

43. The article of claim 1, further comprising a carrier material in the polymer film enclosure, wherein said carrier material comprises a second reservoir of deacidifying agent.

44. The article of claim 43, wherein the carrier material is a backing or mounting board for the paper article.

45. The article of claim 43, wherein the carrier material is a mat frame.

46. The article of claim 43, wherein the second reservoir of deacidifying agent comprises an alkaline material.

47. The article of claim 43, wherein the second reservoir of deacidifying agent comprises an aliphatic amine.

48. The article of claim 43, wherein the deacidifying agent comprises an alkyl amine, a cycloaliphatic amine, an amino-functional ester, an amino-functional acrylate, an amino-functional silicone, an alkoxylated amine, an ethoxylated hydrogenated tallow amine, a hindered amine, or a polyamine.

49. The article of claim 43, wherein the deacidifying agent comprises an alkyl amine containing between 12 and 30 carbon atoms.

50. The article of claim 49, wherein the alkyl amine is dodecylamine, tetradecylamine, hexadecylamine, or octadecylamine.

51. The article of claim 43, wherein the deacidifying agent is a hindered amine.

52. The article of claim 51, wherein the hindered amine is an ester of 2,2,6,6-tetraalkylpiperidinol and a mono-aliphatic carboxylic acid containing from 2 to 17 carbon atoms or a di-aliphatic carboxylic acid containing from 2 to 11 carbon atoms, wherein the alkyls on the piperidinyl ring contain from one to four carbon atoms.

53. The article of claim 51, wherein the hindered amine is bis(2,2,6,6-tetramethyl-4-piperidinyl)sebacate.

54. The article of claim 43, wherein the deacidifying agent is an amino-functional silicone.

55. The article of claim 54, wherein the amino-functional silicone is a aminoalkyl-terminated polydimethylsiloxane or a aminoalkylmethylsiloxane-dimethylsiloxane co-polymer.

56. The article of claim 55, wherein the aminoalkyl is aminopropyl.

57. The article of claim 54, wherein the molecular weight is between about 500 and about 5000.

58. The article of claim 54, wherein the molecular weight is between about 500 and about 1500.

59. The article of claim 54, wherein the molecular weight is between about 800 and about 1000.

60. The article of claim 43, wherein the deacidifying agent comprises an amino-functional silicone having a molecular weight below about 5000.

61. The article of claim 43, wherein the deacidifying agent comprises an aliphatic amine having a molecular weight below about 1000.

62. The article of claim 61, wherein the molecular weight is between about 150 and about 1000.

63. The article of claim 61, wherein the molecular weight is between about 150 and about 500.

64. The article of claim 61, wherein the molecular weight is between about 200 and about 300.

65. The article of claim 43, wherein said deacidifying agent comprises a molecular weight between about 150 and about 5000, and wherein deacidification is effected by migration of the deacidifying agent into the paper article under ambient conditions.

66. The article of claim 43, wherein the deacidifying agent comprises an aliphatic amine having an amine content expressed as NH2, NH, or N of between about 0.5% and about 20% by weight, and a molecular weight between about 150 and about 5000.

* * * * *